US008737887B2

(12) United States Patent
Cavill et al.

(10) Patent No.: US 8,737,887 B2
(45) Date of Patent: May 27, 2014

(54) SHUTTER ASSEMBLY FOR A TONER CONTAINER

(75) Inventors: Gregory Alan Cavill, Winchester, KY (US); Gary Neal Hackney, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 202 days.

(21) Appl. No.: 13/458,249

(22) Filed: Apr. 27, 2012

(65) Prior Publication Data

US 2013/0287446 A1 Oct. 31, 2013

(51) Int. Cl.
*G03G 15/08* (2006.01)

(52) U.S. Cl.
USPC ..... 399/260

(58) Field of Classification Search
CPC ..... G03G 15/0886; G03G 21/1814
USPC ..... 399/260, 258, 106
See application file for complete search history.

(56) References Cited

U.S. PATENT DOCUMENTS 7,466,945 B2 * 12/2008 Hattori
2005/0271425 A1 * 12/2005 Shimomura et al.
2007/0086810 A1 * 4/2007 Yamada et al.

* cited by examiner

*Primary Examiner* — Susan Lee

(57) ABSTRACT

A developer unit including a housing having an opening and defining a volume forming a toner chamber. A shutter is disposed on the housing and rotatably mounted relative to the opening thereof. The shutter includes an aperture and is operative to retain toner within the developer unit in a substantially sealed manner when in a closed orientation in which the aperture is not aligned with the opening of the housing, and to allow toner to flow into the toner chamber through the opening of the housing when in an open orientation in which the aperture is aligned with the opening of the housing. A lever is selectively coupled to the shutter and rotationally mounted to the housing such that when the lever is coupled to the shutter, rotation of the lever causes rotation of the shutter between the open and closed orientations, and when the lever is decoupled from the shutter, the lever is rotatable relative to the housing without causing the shutter to rotate.

20 Claims, 8 Drawing Sheets

SHUTTER ASSEMBLY FOR A TONER CONTAINER

CROSS REFERENCES TO RELATED APPLICATIONS

None

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to electrophotographic imaging devices such as a printer or multifunction device having printing capability, and in particular to shutter assemblies used to open and close toner ports on toner containers.

2. Description of the Related Art

In toner cartridge designs, it is now common practice to separate the longer lived components from those having a shorter life. This has led to having the longer lived developing components such as developer rolls, toner adder rolls, doctor blades, photoconductive drums, cleaning and charge rollers and waste bins to be in separate assemblies from toner cartridges. Toner supply, which is consumed relatively quickly in comparison to the previously described components, is provided in a reservoir in a separate toner cartridge that mates with a developer unit including a developer roll, a toner adder roll, a doctor blade, and a toner sump. Because both the developer unit and toner cartridge are each separable and removable from the imaging devices, both have used shutter assemblies to open and close their respective toner entry and toner exit ports.

The shutters seal the ports of the toner cartridge and the developer unit when the toner cartridge is not inserted in the imaging device. When the toner cartridge mates with the developer unit upon insertion into the imaging device, the shutters open to allow toner from the toner cartridge to pass through its exit port and enter the through the entry port of the developer unit and into the toner sump. The toner exit and entry ports remain in sealing engagement with each other while the toner cartridge remains inserted in the imaging device to prevent toner from escaping.

Typically, the developer unit is initially filled with toner. When the imaging device is shipped from one location to another with the toner cartridge installed therein, the shutters of both the toner cartridge and the developer unit shutter are kept open. During shipping, the ports may jostle against each other and open gaps that may create passageways for toner to escape from the developer unit. If this occurs, toner may be spilled inside the imaging device. Spilled toner may detract from the appearance of the imaging device and, in some cases, may affect some functions of the imaging device compromising overall performance and potentially causing print defects.

In some practices, toner cartridges are left out of imaging devices during shipment to prevent toner leaks. However, this approach requires increasing box sizes which not only increases packaging cost but also shipping cost.

When shipping toner cartridges inside imaging devices, some approaches used to prevent toner leak problems include using shipping separators such as removable plugs, seals, foams, and/or tape. These methods, however, may have drawbacks in terms of reliability and cost. For example, the removable plugs, seals, and/or foams can be subject to assembly variation upon installation especially when performed by human operators which may still result in some level of toner leak. In addition, improper removal of the plugs, seals, and/or foams upon first use may cause problems when the imaging device is operated. Even further, these items are costly but are generally thrown away when the imaging device is first opened. When reshipping the imaging device to another location, these items are not always replaced or repackaged, thereby rendering the imaging device prone to toner leak and toner spill problems during subsequent shipments.

Based upon the foregoing, there is a need for a more sustainable practice and a lower cost solution for preventing toner contamination within an imaging device during shipment.

SUMMARY

Embodiments of the present disclosure provide a developer unit including a shutter assembly that seals the developer unit so as to prevent toner from passing thereto while a toner cartridge is mated therewith. In an example embodiment, a developer unit includes a housing defining a volume forming a toner chamber and including an opening. A shutter is disposed on the housing and rotatably mounted relative to the opening thereof. The shutter includes an aperture and is operative to retain toner within the developer unit in a substantially sealed manner when in a closed orientation in which the aperture is not aligned with the opening of the housing, and to allow toner to flow into the toner chamber through the opening of the housing when in an open orientation in which the aperture is aligned with the opening of the housing. A lever is selectively coupled to the shutter. The lever is rotatable between a first angular position and a second angular position such that when the lever is coupled to the shutter, rotating the lever between the first and second angular positions rotates the shutter between the closed and open orientations, respectively.

When the lever is decoupled from the shutter, the lever is rotatable between the first and second angular positions without rotating the shutter between the closed and open orientations. As such, the lever may be rotated to the second angular position with the shutter remaining in the closed orientation such that when the toner cartridge is mated with the developer unit, the shutter remains closed and retains toner in the developer unit. In this way, occurrences of toner leaks may be reduced or substantially eliminated when shipping the imaging device with the toner cartridge installed therein.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
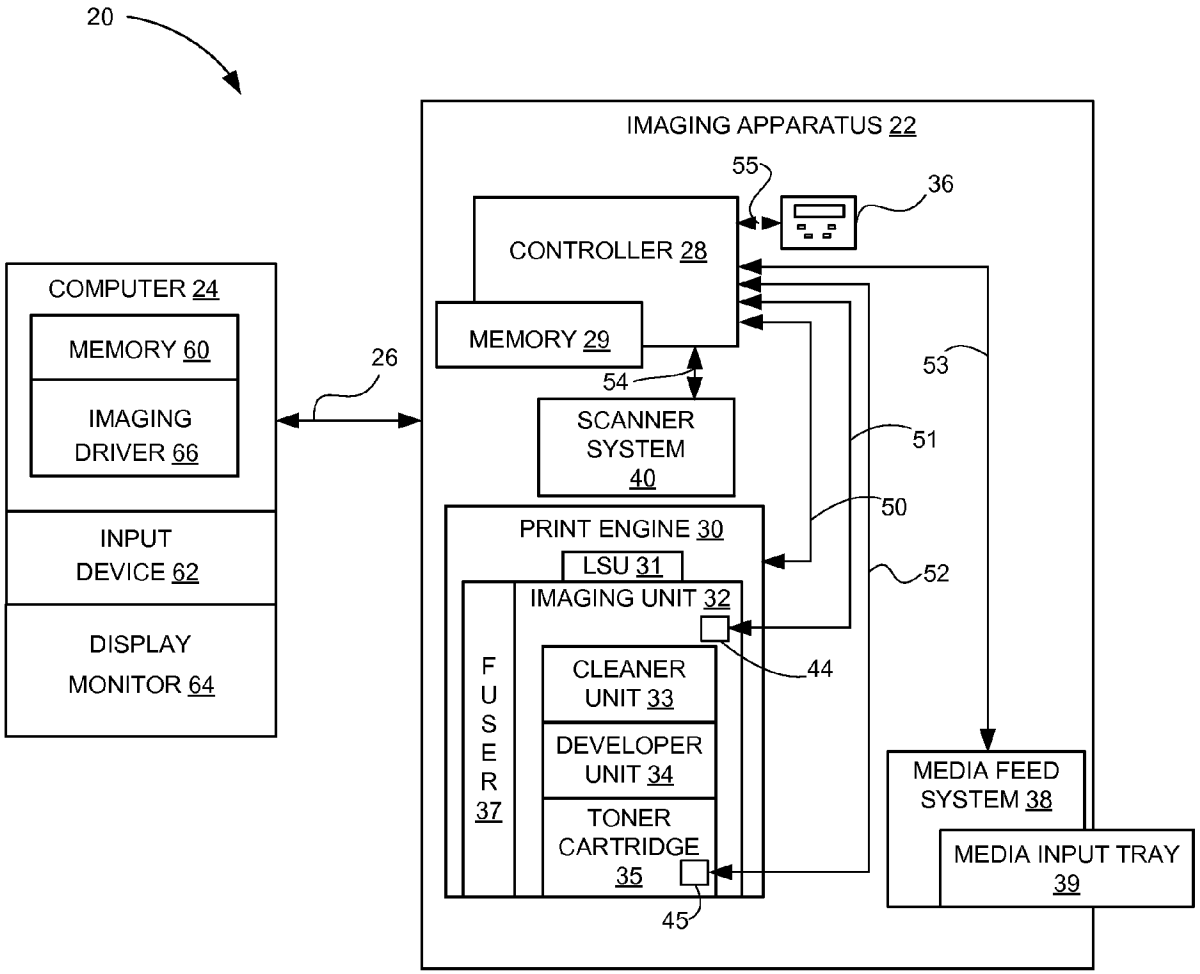
FIG. 1 is a block diagram of an example imaging system utilizing the imaging unit of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

In FIG. 1, there is shown a diagrammatic depiction of an imaging system 20 embodying the present disclosure. As shown, imaging system 20 may include an imaging apparatus 22 and a computer 24. Imaging apparatus 22 communicates with computer 24 via a communications link 26. As used herein, the term "communications link" is used to generally refer to any structure that facilitates electronic communication between multiple components, and may operate using wired or wireless technology and may include communications over the Internet.

In the embodiment shown in FIG. 1, imaging apparatus 22 is shown as a multifunction machine that includes a controller 28, a print engine 30, a laser scan unit (LSU) 31, an imaging unit 32, a developer unit 34, a toner cartridge 35, a user interface 36, a media feed system 38 and media input tray 39, and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40 or a standalone scanner system 40.

Controller 28 includes a processor unit and associated memory 29, and may be implemented as one or more Application Specific Integrated Circuits (ASICs). Memory 29 may be any volatile and/or non-volatile memory such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuit 44, 45 may provide authentication functions, safety and operational interlocks, operating parameters and usage information related to imaging unit 32 and toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, electronic tablet, smartphone or other hand-held electronic device, including memory 60, such as volatile and/or non-volatile memory, an input device 62, such as a keyboard or keypad, and a display monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include laser scan unit (LSU) 31, imaging unit 32, and a fuser 37, all mounted within imaging apparatus 22. The imaging unit 32 further includes a cleaner unit 33 housing a waste toner removal system and a photoconductive drum and developer unit 34 which is removably mounted within print engine 30 of imaging apparatus 32. In one embodiment, the cleaner unit 33 and developer unit 34 are assembled together and installed onto a frame of the imaging unit 32. The toner cartridge 35 is then installed on or in proximity with the frame in a mating relation with the developer unit 34. Laser scan unit 31 creates a latent image on the photoconductive drum in the cleaner unit 33. The developer unit 34 has a toner chamber or sump containing toner which is transferred to the latent image on the photoconductive drum to create a toned image. The toned image is subsequently transferred to a media sheet received in the imaging unit 32 from media input tray 39 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

Figure 2:
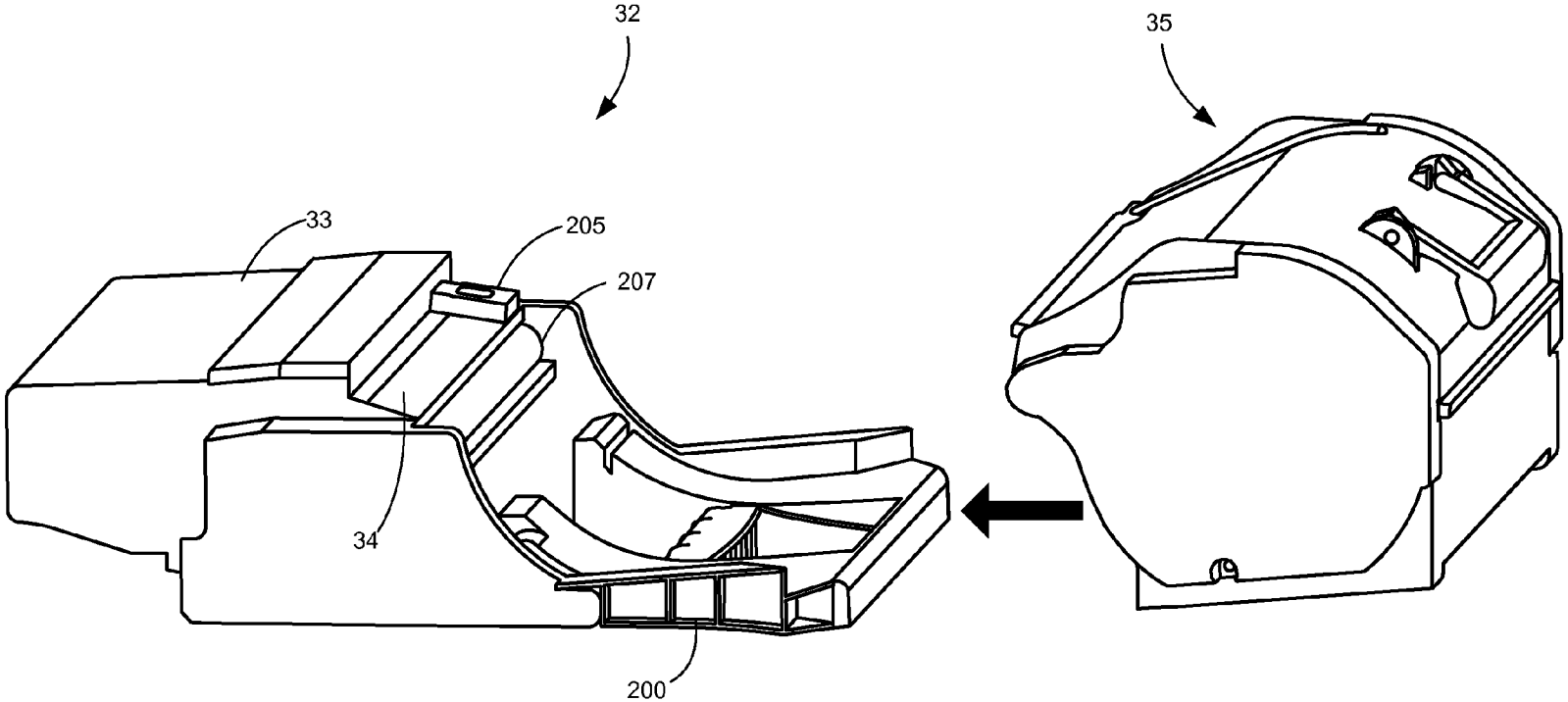
FIG. 2 is a perspective view of an imaging unit and toner cartridge of FIG. 1 in accordance with an example embodiment.

Referring now to FIG. 2, example embodiments of imaging unit 32 and toner cartridge 35 are shown. Imaging unit 32, as illustrated, includes developer unit 34, cleaner unit 33 and a frame 200. Developer unit 34 and cleaner unit 33 are assembled onto or otherwise secured to frame 200. Toner cartridge 35 includes a housing having a toner reservoir enclosed therein for holding a quantity of toner. The imaging unit 32 without toner cartridge 35 is initially slidably received into imaging apparatus 22. The toner cartridge 35 is then slidingly inserted along frame 200 until it is operatively coupled to developer unit 34. This arrangement allows toner cartridge 35 to be separately removed and reinserted easily when replacing an empty toner cartridge or during media jam removal. The developer unit 34, cleaning unit 33 and frame 200 may also be readily slidingly removed and reinserted as a single unit when required. However, this would normally occur with less frequency than the removal and reinsertion of toner cartridge 35.

As mentioned, the toner cartridge 35 removably mates with the developer unit 34 of imaging unit 32. A toner exit port (not shown) on the toner cartridge 35 communicates with a toner entry port 205 disposed on housing 207 of the developer unit 34 allowing toner to be periodically transferred from the toner cartridge 35 to resupply the toner sump in the developer unit 34. To deliver toner from the toner cartridge 35 to the developer unit 34, an auger (not shown) in the toner cartridge 35 may be used to feed toner from the toner cartridge 35 via its exit port into the toner entry port 205 and into a second auger (not shown) that disperse the toner within the developer unit 34. As the toner is drawn out of the toner cartridge 35, it is augered through a shutter assembly (not shown) which regulates whether toner is permitted to exit toner cartridge 35 through its exit port. Another shutter assembly may be used for sealing the entry port 205 of the developer unit 34. During normal use, shutters on one or both of the toner cartridge 35 and the developer unit 34 are moved from a closed orientation to an open orientation as the toner cartridge 35 is inserted into the imaging apparatus 22. Additionally, the shutters are moved from the open orientation to the closed orientation as the toner cartridge is removed from the image forming apparatus 22.

Figure 3:
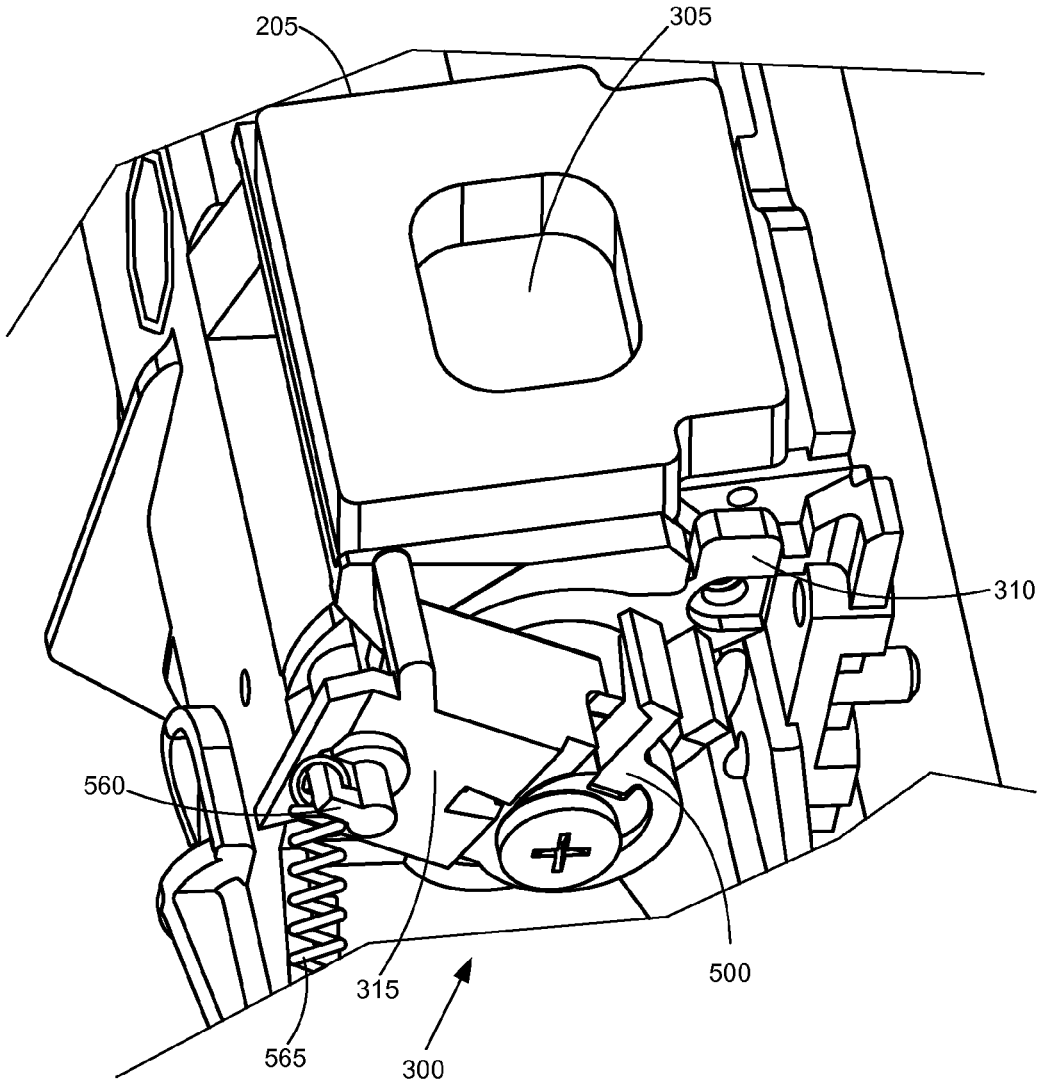
FIG. 3 is a perspective view of a portion of a developer unit of FIG. 2 having a shutter assembly according to an example embodiment.
Figure 4:
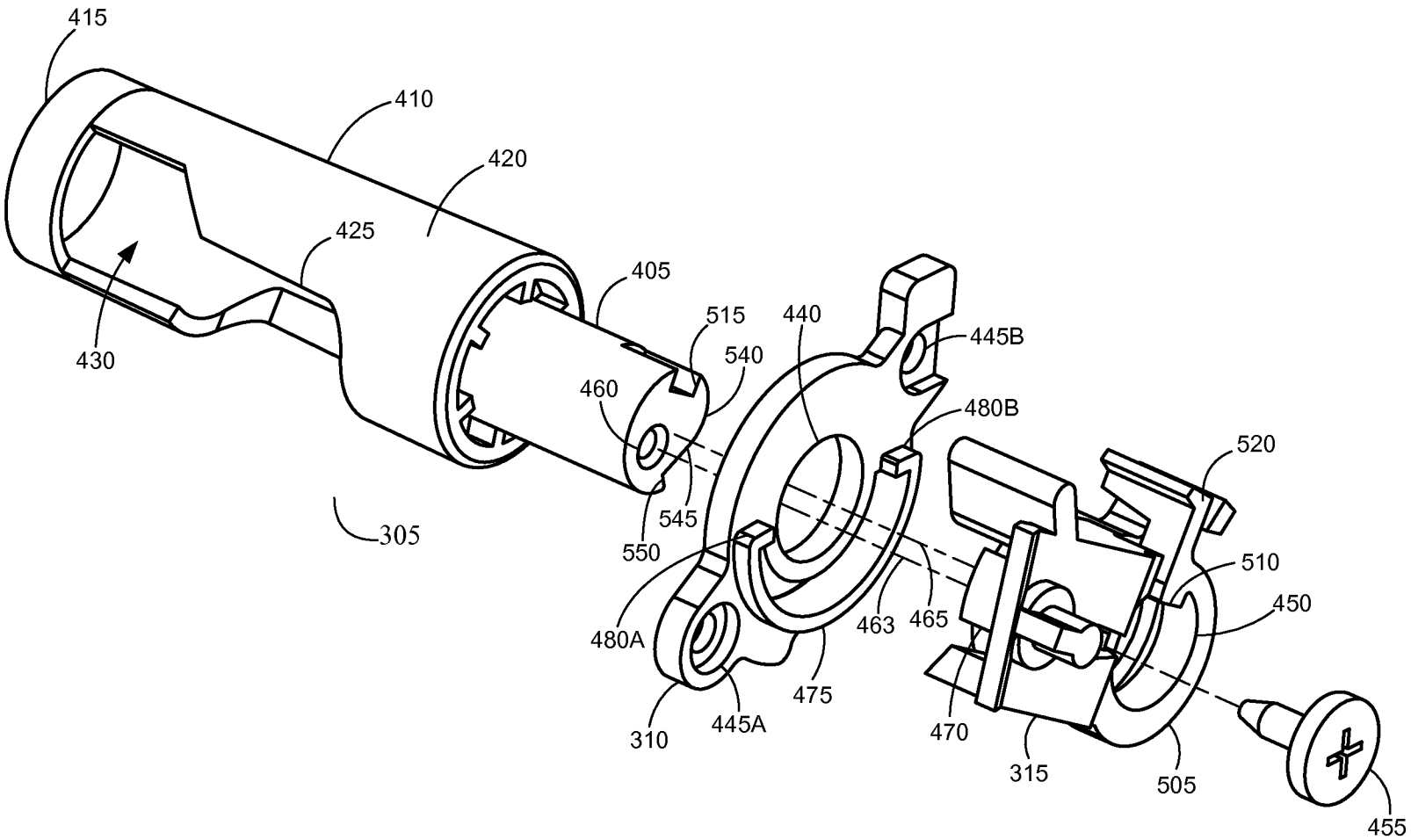
FIG. 4 is an exploded view of the shutter assembly in FIG. 3.
Figure 6A:
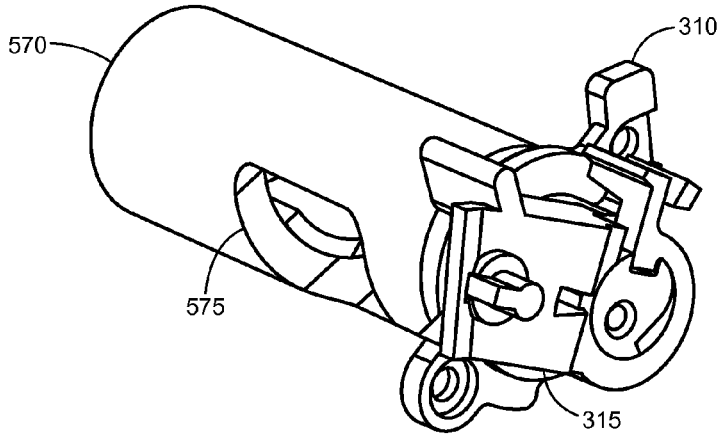
FIGS. 6A-6C illustrate different positions of the lever in FIG. 4, relative to a shutter of the shutter assembly in FIG. 3, according to an example embodiment.
Figure 6B:
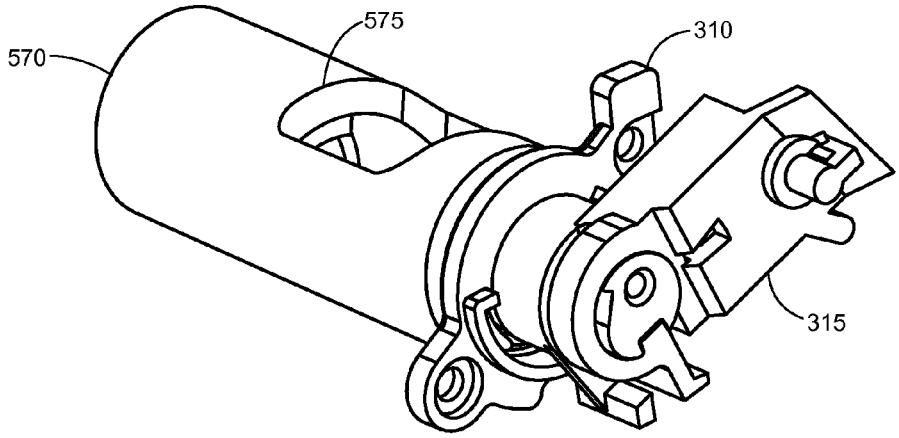
Figure 6C:
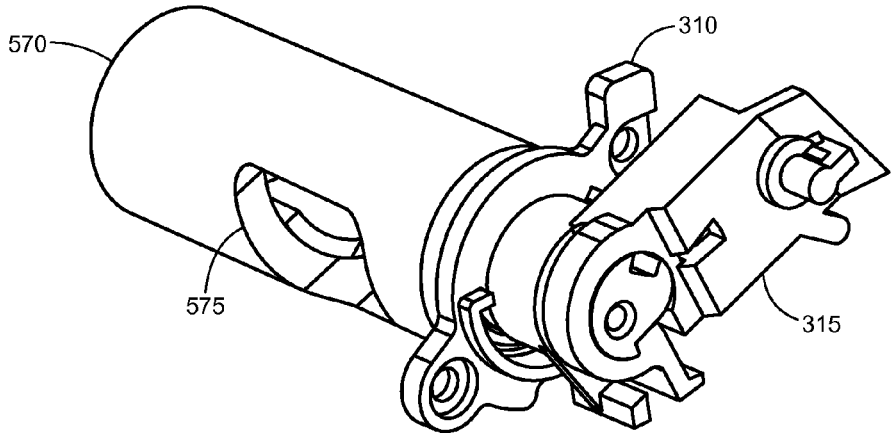

FIG. 3 shows the toner entry port 205 of the developer unit 34 with an associated shutter assembly 300. FIG. 4 illustrates an exploded view of the shutter assembly 300 in FIG. 3. As shown, shutter assembly 300 is provided at one end of the developer unit 34 adjacent toner entry port 205. Shutter assembly 300 includes a shutter 305, a retainer 310, and a lever 315. In an example embodiment, shutter 305 has a generally cylindrical body including an end portion 405 and a hollow portion 410. Hollow portion 410 defines an open end 415 and has a wall 420 defining an aperture 425. When the aperture 425 is aligned with entry port 205, toner from the toner cartridge 35 drops through the aperture 425 and into a channel 430 formed between the aperture 425 and the open end 415. An auger (not shown) is received within channel 430 for distributing toner into the toner sump of the developer unit 34. A seal 570 may be assembled or molded onto the exterior of the hollow portion 410 of shutter 305, as shown in FIGS. 6A-6C, to provide an effective seal while having a reduced frictional contact area with the housing 207 and allowing for lower torque to operate shutter 305. Seal 570 includes an opening 575 that is aligned with aperture 425 of shutter 305 for receiving toner from the exit port of toner cartridge 35 through toner entry port 205.

With further reference to FIGS. 3 and 4, end portion 405 of shutter 305 passes through an opening 440 in retainer 310 and is rotatable within opening 440. Fasteners are inserted through holes 445A, 445B in retainer 310 and are received into corresponding holes in housing 207 of developer unit 34 so as to fix retainer 310 and rotatably secure shutter 305 in housing 207. End portion 405 also passes through an opening 450 of lever 315. Another fastener 455, such as a screw, passes through opening 450 of lever 315 and opening 440 of retainer 310 and is received in a threaded hole 460 provided on the end portion 405 of shutter 305 for maintaining the connections between the components of shutter assembly 300. In an example embodiment, the axis of insertion 463 for fastener 455 is offset from the axis of rotation 465 of shutter 305 and lever 315 such that fastener 455 contacts both shutter 305 and at least a portion of lever 315 thereby securing lever 315 to shutter 305. Shutter 305 is rotatable by lever 315 between a closed orientation wherein a toner passageway through toner entry port 205 is closed and an open orientation where the toner passageway is open, as will be explained in greater detail below.

A back protrusion 470 extends from a back portion of lever 315. Retainer 310 includes an arced shaped member 475 having stops 480A, 480B at both ends thereof. Arced shaped member 475 facilitates rotation of lever 315 relative to retainer 310. Stops 480A, 480B limit the rotational movement of lever 315 by engaging with back protrusion 470. A pin 560 is provided at a distal end of lever 315 for attaching to one end of a biasing spring 565 (FIG. 3). A second end of the biasing spring 565 may be coupled to housing 207 such that spring 565 urges the lever 315 towards one or more angular positions as described below. Lever 315 may further include a first side wall 710 and a second side wall 715 for engaging with toner cartridge 35 as discussed in greater detail below.

According to example embodiments of the present disclosure, lever 315 may be selectively decoupled from shutter 305 so that the shutter 305 may remain in the closed orientation even though toner cartridge 35 is mated with developer unit 34 during installation within the imaging apparatus 22. According to the example embodiment shown in FIGS. 3 and 4, lever 315 and shutter 305 may include a latch mechanism 500 for coupling and decoupling the lever 315 from the shutter 305. Latch mechanism 500 may include a substantially arcuate resilient member 505 extending from an end of the lever 315 and surrounding at least a section of the end portion 405 of shutter 305. Resilient member 505 may be integrally molded as part of lever 315 or be formed as a separate component that is attached to lever 315. In addition, resilient member 505 may have other shapes or forms. Resilient member 505 may include a protrusion 510 while the end portion 405 of shutter 305 may include a recess 515 that is sized to receive protrusion 510. When the protrusion 510 engages in recess 515, rotation of the lever 315 causes rotation of the shutter between the open and closed orientations. It will be appreciated that shutter 305 and lever 315 may be coupled by any suitable means such as, for example, by reversing the protrusion/recess configuration such that the end portion 405 of shutter 305 includes a protrusion and lever 315 includes a recess.

Figure 5:
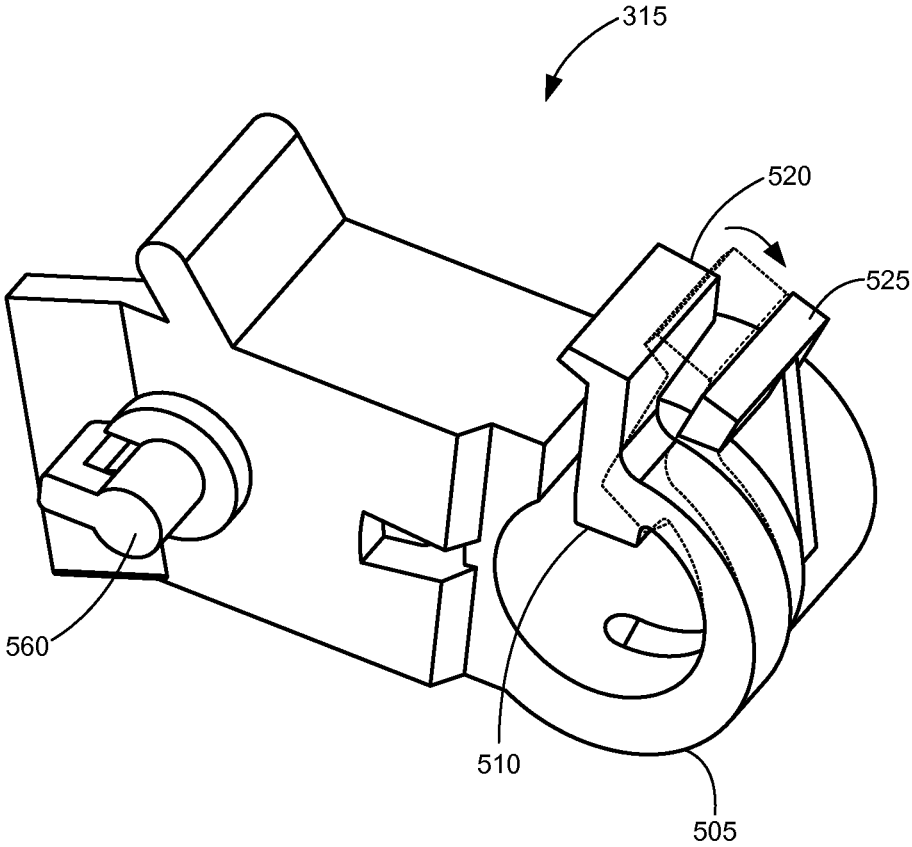
FIG. 5 illustrates a lever of the shutter assembly in FIG. 3.

Resilient member 505 includes a release member 520 disposed at a distal end thereof adjacent the protrusion 510 and arranged to receive force from a user. When a user-applied force temporarily overcomes the spring force of resilient member 505, resilient member 505 is deflected, as shown by phantom lines in FIG. 5, causing the protrusion 510 to disengage from the recess 515. When the protrusion 510 and recess 515 are disengaged, the lever 315 is decoupled from the shutter 305 such that the lever 315 can rotate without rotating the shutter 305 therewith. In an example embodiment, release member 520 may be shaped to allow users to easily disengage the protrusion 510 from the recess 515 by direct contact, such as by the use of a finger or finger nail, or indirect contact using a handheld tool. In the example embodiment shown in FIG. 5, release member 520 has a substantially inverted L-shape. It will be appreciated that other shapes or structures may be utilized for release member 520.

Lever 315 may further include a stop member 525 disposed proximate release member 520 for limiting an amount of deflection of resilient member 505 as release member 520 receives the user-applied force. In particular, stop member 525 extends into the deflectable path of release member 520 so as to prevent further deflection thereof.

The end portion 405 of shutter 305 includes a cam surface 540 disposed adjacent the recess 515. The cam surface 540 includes a curved profile 545 for contacting the protrusion 510 as the lever 315 is decoupled from the shutter 305 and rotated. The curved profile 545 extends from the recess 515 to an ending 550 which defines a dwell for providing a location for protrusion 510 to be positioned when the lever 315 is decoupled from the shutter 305 and rotated. In an example embodiment, the dwell may have a depth similar to that of recess 515 so as to maintain resilient member 505 in a substantially undeflected state while protrusion 510 rests in the dwell.

With reference to FIGS. 6A-6C, the operation of the shutter assembly 300 will now be described in more detail. Lever 315 is rotatable between a first angular position, as shown in FIG. 6A, and a second angular position, as shown in FIGS. 6B and 6C. As discussed above, stops 480A, 480B on retainer 310 limit the rotation of lever 315 between the first and second angular positions due to engagement with the back protrusion 470 of lever 315 (FIG. 4). The spring 565 coupled to pin 560 urges the lever 315 first to one of the angular positions and over center of assembly 300 to the other angular position.

FIGS. 6A and 6B show the lever 315 being operatively coupled to the shutter 305 as protrusion 510 of resilient member 505 is matingly inserted into recess 515 of the end portion 405 of shutter 305. When rotated to the first angular position, as shown in FIG. 6A, the lever 315 rotates shutter 305 to the closed orientation in which opening 575 of seal 570 and aperture 425 of shutter 305 are not aligned with the toner entry port 205 and, instead, are rotated against a solid wall of housing 207 as shown in FIG. 3. In such arrangement, toner is prevented from passing through or leaking out of the developer unit 34 through toner entry port 205 thereby retaining toner within the developer unit 34 in a substantially sealed manner. When rotated to the second angular position, as shown in FIG. 6B, the lever 315 rotates shutter 305 to the open orientation in which opening 575 of seal 570 and aperture 425 of shutter 305 are aligned with the toner entry port 205 of developer unit 34. As such, toner entry port 205 is open and toner from the exit port of toner cartridge 35 may drop through the opening 575 of seal 570 and into the shutter 305 with the assistance of gravity.

While the lever 315 and shutter 305 are in their respective first angular position and closed orientation as shown in FIG. 6A, such as when toner cartridge is removed from the imaging apparatus 22, lever 315 may be decoupled from the shutter 305. In particular, protrusion 510 of resilient member 505 may be disengaged from recess 515 of the end portion 405 of shutter 305 by applying a force onto release member 520 sufficient enough to temporarily deflect resilient member 505 and dislodge protrusion 510 from recess 515. Thereafter, lever 315 may be rotated to the second angular position without rotating the shutter therewith. As shown in FIG. 6C, lever 315 is in the second angular position while the shutter 305 remains in the closed orientation following decoupling of the shutter 305 and the lever 315. As the lever 315 is rotated to the second angular position following disengagement of the protrusion 510 from the recess 515, protrusion 510 travels along the profile 545 of cam surface 540, gradually returning resilient member 505 to its undeflected state as protrusion 510 approaches the dwell at ending 550.

From the arrangement shown in FIG. 6C, lever 315 may be rotated from the second angular position back to the first angular position. Since lever 315 is not coupled to shutter 305, lever 315 rotates while shutter 305 remains in the closed orientation. As lever 315 is rotated towards the first angular position, protrusion 510 follows the profile 545 of cam surface 540 and eventually mates with the recess 515 when aligned therewith. As such, protrusion 510 and recess 515 automatically re-engage when aligned with each other, thereby recoupling the shutter 305 and the lever 315, as shown in FIG. 6A.

Figure 7A:
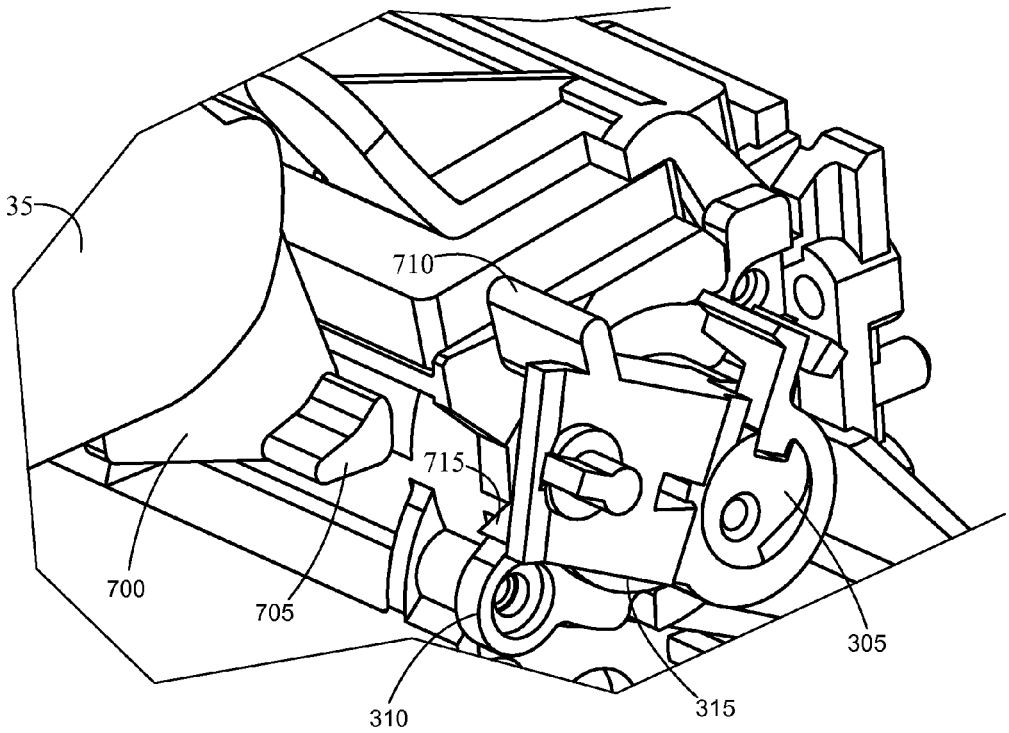
FIGS. 7A-7C illustrate the shutter assembly of FIG. 3 in conjunction with a toner cartridge, according to an example embodiment.
Figure 7B:
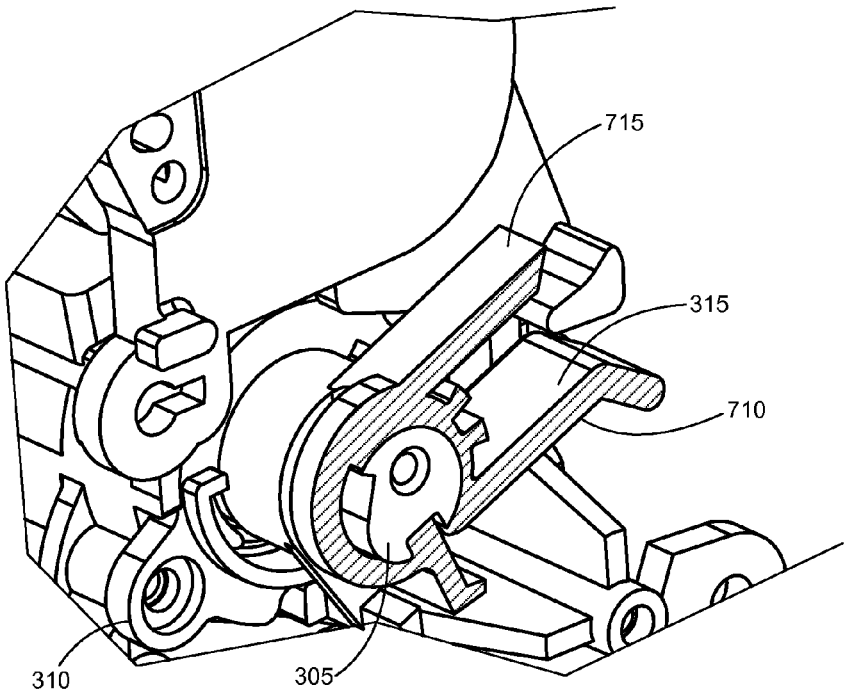
Figure 7C:
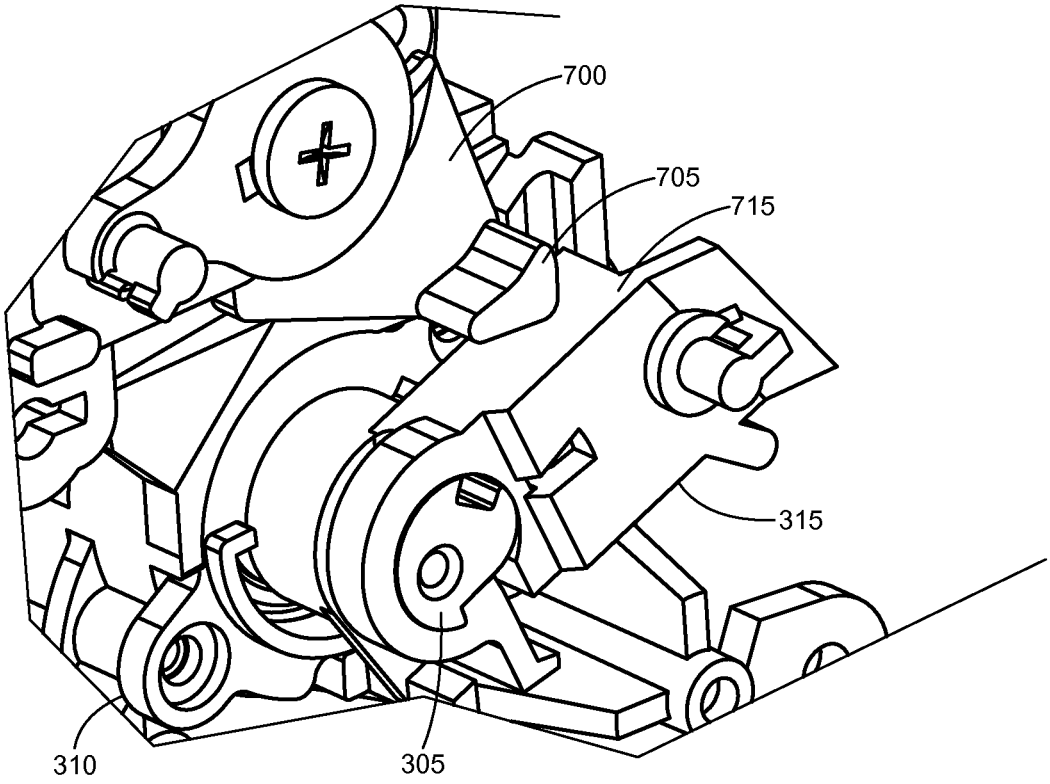

With reference to FIGS. 7A-7C, the interaction between toner cartridge 35 and the shutter assembly 300 of developer unit 34 will now be described. Toner cartridge 35 may include an engagement arm 700 having a protruding boss 705, as shown in FIGS. 7A-7C. Engagement arm 700 is used to actuate lever 315 of shutter assembly 300 to move shutter 305 between the open and closed orientations during insertion and removal of toner cartridge 35, respectively, while lever 315 and shutter 305 are coupled to each other. FIG. 7A illustrates toner cartridge 35 just prior to engagement with shutter assembly 300, and FIG. 7B illustrates toner cartridge 35 following such engagement. As toner cartridge 35 advances towards its final position in imaging apparatus 22 to be mated with developer unit 34, protruding boss 705 contacts first side wall 710 of lever 315 thereby urging lever 315 to rotate from the first angular position shown in FIG. 7A to the second angular position shown in FIG. 7B. In particular, the space between the first side wall 710 and the second side wall 715 of lever 315 receives the protruding boss 705 upon insertion of the toner cartridge 35 into the imaging apparatus 22.

Similarly, engagement arm 700 actuates lever 315 to move from the second angular position to the first angular position as toner cartridge 35 is removed from the imaging apparatus 22. In particular, protruding boss 705 engages second side wall 715 of lever 315, causing lever 315 to rotate from the second angular position (FIG. 7B) to the first angular position (FIG. 7A). In both instances of cartridge insertion and withdrawal, shutter 305 is rotated between the open and closed orientations as a consequence of lever 315 being coupled to shutter 305 and protrusion 510.

As described above, toner cartridge 35 may be installed within imaging apparatus 35 without rotating shutter 305 to the open orientation. This can be achieved by initially decoupling lever 315 from shutter 305 and rotating lever 315 to the second angular position (FIG. 6B) while allowing shutter 305 to remain in the closed orientation prior to installing toner cartridge 35 within imaging apparatus 22. FIG. 7C illustrates lever 315 initially positioned in the second angular position while shutter 305 remains in the closed orientation, corresponding to the arrangement of the shutter assembly 300 shown in FIG. 6C. Upon insertion of toner cartridge 35, protruding boss 705 of engagement arm 700 engages the exterior surface of second side wall 715 of lever 315. Further advancement of the toner cartridge 35 into the imaging apparatus 22 causes protruding boss 705 to travel up and over the second side wall 715 and drop into a working position where it is disposed between the first side wall 710 and the second side wall 715 of lever 315, as shown for example in FIG. 7B. Toner cartridge 35 is thus positioned within imaging apparatus 22 with shutter 305 in the closed orientation. In this way, imaging apparatus 22 may then be shipped or transported with toner cartridge 35 installed therein and with the entry port 205 of developer unit 34 substantially sealed such that toner may be prevented from leaking out of the developer unit 34 during shipping.

When toner cartridge 35 is then removed from the imaging apparatus 22 after shipping, engagement arm 700 actuates lever 315 to rotate from the second angular position to the first angular position by engaging second side wall 715. As lever 315 moves towards the second angular position, protrusion 510 travels along the profile 545 of cam surface 540 from the dwell until it re-engages with recess 515 to recouple the lever 315 and the shutter 305 as shown in the arrangement illustrated in FIG. 7A. Thus, shutter assembly 300 automatically returns to its working condition, unbeknownst to the user removing cartridge 35, such that it can open and close shutter 305 upon subsequent installation and removal of toner cartridge 35. All that is needed to recouple the lever 315 and the shutter 315 is to withdraw toner cartridge 35 following shipping, after which reinsertion of toner cartridge 35 results in toner cartridge 35 and developer unit 34 mating and establishing a toner passageway therebetween.

The above embodiments thus provide a means to allow a developer unit to be closed when a toner cartridge is transported together with an imaging device while installed therein. Upon removal of the toner cartridge, the shutter assembly of the developer unit is automatically reconfigured to a normal operating configuration.

The description of the details of the example embodiments have been described using the shutter assembly for the developer unit. However, it will be appreciated that the teachings and concepts provided herein are applicable to other toner containers as well.

The foregoing description of several methods and example embodiments has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A developer unit, comprising:

a housing defining a volume forming a toner chamber, the housing including an opening;

a shutter disposed on the housing and rotatably mounted relative to the opening thereof, the shutter including an aperture and being operative to retain toner within the developer unit in a substantially sealed manner when in a closed orientation in which the aperture is not aligned with the opening of the housing, and to allow toner to flow into the toner chamber through the opening of the housing when in an open orientation in which the aperture is aligned with the opening of the housing; and a lever selectively coupled to the shutter and rotationally mounted to the housing such that when the lever is coupled to the shutter, rotation of the lever causes rotation of the shutter between the open and closed orientations, and when the lever is decoupled from the shutter the lever is rotatable relative to the housing without causing the shutter to rotate.

2. The developer unit of claim 1, wherein the lever and the shutter include a latch mechanism for decoupling the lever from the shutter.

3. The developer unit of claim 2, wherein the latch mechanism includes a protrusion and a recess, the protrusion extending from one of the shutter and the lever and the recess being defined in the other of the shutter and the lever, the shutter being coupled to the lever when the protrusion is matingly inserted into the recess.

4. The developer unit of claim 3, wherein the latch mechanism further includes an extension member formed with one of the protrusion and the recess, the extension member being resiliently deflectable such that deflection of the extension member causes the protrusion to be removed from the recess and the lever to be decoupled from the shutter.

5. The developer unit of claim 4, wherein following decoupling of the shutter and the lever, the protrusion substantially automatically mates with the recess when aligned therewith, thereby recoupling the shutter and the lever.

6. The developer unit of claim 4, wherein the shutter includes a cam surface, the cam surface defining a path along which the protrusion is disposed while the protrusion is removed from the recess.

7. A toner container, comprising:

a body defining a volume forming a toner chamber, the body including an opening for receiving toner into the toner chamber;

a shutter having a wall disposed on the body and rotatable, relative to the opening of the body, between a closed orientation to cover the opening and retain toner within the toner chamber, and an open orientation to uncover the opening and allow toner to flow therethrough into the toner chamber; and a lever selectively coupled to the shutter such that when the lever is coupled to the shutter, rotation of the lever rotates the shutter between the closed and open orientations, and when the lever is decoupled from the shutter, the lever rotates without rotating the shutter.

8. The toner container of claim 7, wherein the lever is rotatable between a first angular position and a second angular position such that when the lever is coupled to the shutter, rotating the lever between the first and second angular positions rotates the shutter between the closed and open orientations, respectively, and when the lever is decoupled from the shutter, the lever is rotatable between the first and second angular positions without rotating the shutter between the closed and open orientations.

9. The toner container of claim 8, further comprising a biasing spring for urging the lever to either or both of the first and second angular positions.

10. The toner container of claim 7, further comprising a latch mechanism for decoupling the lever from the shutter.

11. The toner container of claim 10, wherein the latch mechanism includes a substantially arcuate resilient member formed with the lever and surrounding at least a portion of the shutter, one of the resilient member and the shutter having a protrusion and the other of the resilient member and the shutter having a recess that is sized to receive the protrusion to couple the lever and the shutter.

12. The toner container of claim 11, wherein the resilient member includes a release member for receiving a user-applied force to deflect the resilient member and disengage the protrusion from the recess so as to decouple the lever from the shutter.

13. The toner container of claim 12, wherein following disengagement of the protrusion from the recess, the protrusion and the recess re-engage when aligned with each other upon rotation of the lever.

14. A toner container, comprising:

a housing defining a volume forming a toner chamber, the housing including an opening;

a shutter disposed on the housing and having a rotational axis, the shutter including an aperture and being operative to retain toner within the toner chamber in a substantially sealed manner when in a closed orientation in which the aperture is not aligned with the opening of the housing, and to allow toner to flow into the toner chamber through the opening of the housing when in an open orientation in which the aperture is aligned with the opening of the housing; and a lever pivotable about the rotational axis of the shutter and selectively coupled to the shutter such that when the lever is coupled to the shutter, rotation of the lever about the rotational axis rotates the shutter between the closed and open orientations, and when the lever is decoupled from the shutter, the lever rotates without rotating the shutter.

15. The toner container of claim 14, wherein the lever and the shutter include a latch mechanism for selectively decoupling the lever from the shutter.

16. The toner container of claim 15, wherein the latch mechanism includes a resilient member formed with the lever and surrounding at least a portion of the shutter, the resilient member having one of a protrusion and a recess and the shutter having the other of the protrusion and the recess, the lever being coupled to the shutter when the protrusion is matingly inserted into the recess.

17. The toner container of claim 16, wherein the resilient member includes a release member for receiving a user-applied force to deflect the resilient member and remove the protrusion from the recess so as to decouple the lever from the shutter.

18. The toner container of claim 16, wherein the shutter includes a surface disposed adjacent the recess, the surface being configured to contact the protrusion when the protrusion is removed from the recess.

19. The toner container of claim 18, wherein following decoupling of the shutter and the lever, the protrusion substantially automatically mates with the recess when aligned therewith upon rotational movement of the lever, thereby recoupling the shutter and the lever.

20. The imaging device of claim 14, further comprising first and second stop members and a protrusion member, one of the protrusion member and the stop members being associated with the lever so as to limit an amount of rotation thereof.

* * * * *